US008866729B2

(12) United States Patent
Keum et al.

(10) Patent No.: US 8,866,729 B2
(45) Date of Patent: Oct. 21, 2014

(54) METHOD FOR DRIVING LIQUID CRYSTAL DISPLAY DEVICE

(75) Inventors: Min Ha Keum, Cheonan-si (KR); Tae Kwon Jung, Asan-si (KR); Dae-Gwang Jang, Incheon (KR); Dong Hak Pyo, Cheonan-si (KR); Hak-Mo Choi, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 392 days.

(21) Appl. No.: 13/240,033

(22) Filed: Sep. 22, 2011

(65) Prior Publication Data

US 2012/0194568 A1 Aug. 2, 2012

(30) Foreign Application Priority Data

Feb. 1, 2011 (KR) ..... 10-2011-0010210

(51) Int. Cl.
*G09G 3/36* (2006.01)
*G09G 3/34* (2006.01)

(52) U.S. Cl.
CPC ..... *G09G 3/342* (2013.01); *G09G 2330/021* (2013.01); *G09G 2320/0646* (2013.01); *G09G 2360/16* (2013.01); *G09G 3/3426* (2013.01); *G09G 3/3648* (2013.01)
USPC ..... 345/102; 345/84; 345/87; 345/89; 345/690; 362/97.1

(58) Field of Classification Search
USPC ..... 345/102, 690, 84, 87, 89; 362/97.1
See application file for complete search history.

(56) References Cited

U.S. PATENT DOCUMENTS

| | | | | |
|---|---|---|---|---|
| 2007/0268242 | A1* | 11/2007 | Baba et al. | 345/102 |
| 2009/0267926 | A1* | 10/2009 | Seo et al. | 345/204 |
| 2010/0114736 | A1 | 5/2010 | Lewis et al. | |

FOREIGN PATENT DOCUMENTS

| | | |
|---|---|---|
| JP | 2001-195035 | 7/2001 |
| JP | 2005-208259 | 8/2005 |
| JP | 3873917 | 11/2006 |
| JP | 4214480 | 11/2008 |
| KR | 10-0556383 | 2/2006 |
| KR | 10-2008-0078210 | 8/2008 |
| KR | 10-2009-0004016 | 1/2009 |
| KR | 10-2009-0095797 | 9/2009 |
| KR | 10-2010-0033731 | 3/2010 |

OTHER PUBLICATIONS

English Abstract for Publication No. 2001-195035, published Jul. 19, 2001.

(Continued)

*Primary Examiner* — Alexander S Beck
*Assistant Examiner* — Amen Bogale
(74) *Attorney, Agent, or Firm* — F. Chau & Associates, LLC

(57) ABSTRACT

A method of driving a light source unit of a liquid crystal display panel according to an exemplary embodiment of the present disclosure includes the steps of calculating average and maximum values of image signals applied to the liquid crystal panel; calculating a representative value of the image signals using the average and maximum values; determining the luminance of the light source unit according to the representative value and driving the light source unit accordingly. The representative value may be calculated from $L_{rep}=(1-\beta)\times L_{avg}+\beta\times L_{max}$, where $L_{rep}$ is a representative value, $L_{avg}$ is an average value, $L_{max}$ is the maximum value, and $\beta$ is a value that decreases as a difference between the maximum and average image signal values increases, and has a range between 0 and 1.

6 Claims, 8 Drawing Sheets

(56) References Cited

OTHER PUBLICATIONS

English Abstract for Publication No. 2005-208259, published Aug. 4, 2005.
English Abstract for Publication No. 10-0556383, issued Feb. 23, 2006.
English Abstract for Publication No. 3873917, issued Nov. 2, 2006.
English Abstract for Publication No. 10-2008-0078210, published Aug. 27, 2008.
English Abstract for Publication No. 4214480, issued Nov. 14, 2008.
English Abstract for Publication No. 10-2009-0004016, published Jan. 12, 2009.
English Abstract for Publication No. 10-2009-0095797 published Sep. 10, 2009.
English Abstract for Publication No. 10-2010-0033731, published Mar. 31, 2010.

* cited by examiner

METHOD FOR DRIVING LIQUID CRYSTAL DISPLAY DEVICE

CROSS-REFERENCE TO RELATED APPLICATION

This application claims priority from Korean Patent Application No. 10-2011-0010210 filed in the Korean Intellectual Property Office on Feb. 1, 2011, the contents of which are herein incorporated by reference in their entirety.

BACKGROUND (a) Technical Field

The present disclosure is directed to a method of driving a liquid crystal display. More particularly, the present disclosure is directed to a method of driving a liquid crystal display that can dim-drive a light source by selecting a representative luminance value based on the entire luminance distribution of the corresponding image.

(b) Description of the Related Art

Liquid crystal displays are currently among the most widely used flat panel displays, and each includes two display panels on which field generating electrodes such as pixel electrodes and common electrodes are formed, and a liquid crystal layer disposed therebetween. Liquid crystal displays display an image by applying a voltage to a field generating electrode to generate an electric field in the liquid crystal layer, which determines alignment of the liquid crystal molecules of the liquid crystal layer and controls polarization of incident light.

Since a liquid crystal display is not self-emissive, a light source is required. In this case, the light source may be a separately provided artificial light source or a natural light source. Artificial light sources used for liquid crystal displays include light emitting diodes (LED), cold cathode fluorescent lamps (CCFL), and external electrode fluorescents (EEFL).

Recently, a dimming driving method that controls the light intensity of a light source based on the luminance of an entire image have been developed that minimize power consumption and prevent reduction of the image's contrast ratio (CR).

Various methods may be used for selecting a representative luminance value for the corresponding image, but all select a representative value without considering the overall luminance distribution of the corresponding image.

Thus, if a low value is selected as the representative value to reduce power consumption, the luminance of a bright screen may be significantly decreased. On the other hand, if a high value is selected as the representative value to prevent luminance deterioration, light source luminance may be increased even for relatively dim screens, thus contravening the purpose of reducing power consumption.

SUMMARY

Embodiments of the present disclosure provide a method of driving a liquid crystal for dimming-driving a light source by selecting a representative value based on the entire luminance distribution of the corresponding image.

In further detail, embodiments of the present disclosure provide a method for dimming-driving a light source unit of a liquid crystal display by selecting a representative value that maximizes power consumption reduction without significantly deteriorating luminance.

A method for driving a light source unit of a liquid crystal display panel according to an exemplary embodiment of the present invention includes: (a) calculating average and maximum values of image signals applied to the liquid crystal panel; (b) calculating a representative value of the image signals using the average and maximum values; and (c) determining a luminance of the light source unit based on the representative value and driving the light source unit accordingly. The representative value is calculated from $L_{rep}=(1-\beta)\times L_{avg}+\beta\times L_{max}$, where $L_{rep}$ is the representative value, $L_{avg}$ is the average value, and $L_{max}$ is the maximum value. The value of $\beta$ decreases as a difference between the maximum and average values increases, and is between 0 and 1.

The liquid crystal panel includes a plurality of regions and the light source unit comprises a plurality of blocks corresponding to the plurality of regions. The average and maximum values are calculated for each region, the representative value is calculated for each region, and the luminance of the light source unit is determined separately for each block.

The value of $\beta$ is calculated from $\beta=\beta_{min}+\alpha\times(\beta_{max}-\beta_{min})$, where $\beta_{min}$ and $\beta_{max}$ are minimum and maximum values for $\beta$, respectively, and $\alpha$ is a constant with a value between 0 and 1.

The value of $\alpha$ decreases as a difference between the maximum and average values increases.

The value of $\alpha$ is 1 when the difference between the maximum and average value is 0, and 0 when the difference is 255.

The value of $\beta_{min}$ is between about 0 and about 0.5.

The value of $\beta_{max}$ is between about 0.5 and about 1.

A method for driving a light source unit for a liquid crystal display panel according to another exemplary embodiment of the present invention includes calculating average and maximum values of image signals applied to the liquid crystal panel; calculating a representative value of the image signals from the average and maximum values; and determining a luminance of the light source unit based on the representative value and driving the light source unit accordingly. The liquid crystal panel includes a plurality of regions, and the light source unit includes a plurality of blocks corresponding to the plurality of regions, where the average and maximum values are calculated for each region, the representative value is calculated for each region, and the luminance of the light source unit is determined separately for each block.

The representative value is calculated from $L_{rep}=(1-\beta)\times L_{avg}+\beta\times L_{max}$, where $L_{rep}$ is the representative value, $L_{avg}$ is the average value, and $L_{max}$ is the maximum value, and the value of $\beta$ decreases as a difference between the maximum and average values increases, and is between 0 and 1.

The value of $\beta$ is calculated from $\beta=\beta_{min}+\alpha\times(\beta_{max}-\beta_{min})$, where $\beta_{min}$ and $\beta_{max}$ are minimum and maximum values for $\beta$, respectively, and $\alpha$ is a constant with a value between 0 and 1. The value of $\alpha$ decreases as a difference between the maximum and average luminance values increases.

A method for driving a liquid crystal display according to an embodiment of the present disclosure dimming-drives the light source unit by calculating a representative value from a difference between an average and a maximum image signal value, thereby dimming-driving the light source based on the entire luminance distribution of the corresponding image.

Thus, a representative value for image signals of a screen that is generally dark and partially lit is set close to an average image signal value, and a representative value for image signals of a screen that is generally bright and partially dim is set close to a maximum image signal value to reduce power consumption without deteriorating luminance.

DETAILED DESCRIPTION OF EXEMPLARY EMBODIMENTS

Figure 1:
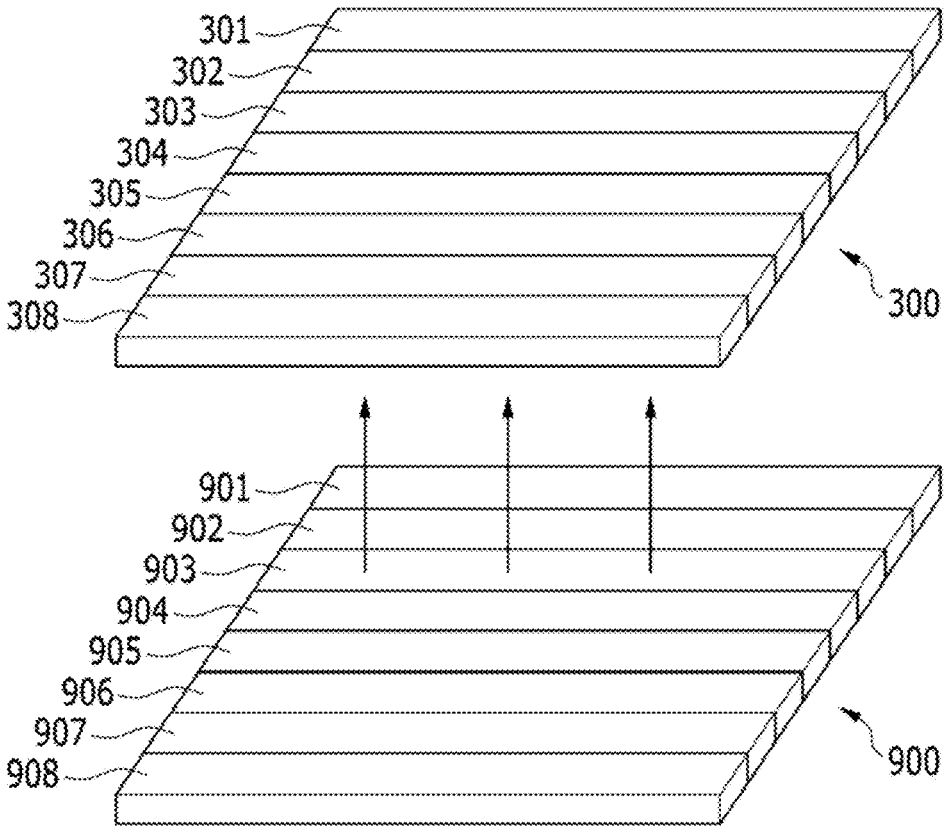
FIG. 1 is an exploded perspective view of a liquid crystal display according to an embodiment of the present disclosure.

Embodiments of the present disclosure will be described more fully hereinafter with reference to the accompanying drawings, in which exemplary embodiments of the invention are shown. In the drawings, the thickness of layers, films, panels, regions, etc., are exaggerated for clarity. Like reference numerals may designate like elements throughout the specification. It will be understood that when an element such as a layer, film, region, or substrate is referred to as being "on" another element, it can be directly on the other element or intervening elements may also be present.

Hereinafter, a liquid crystal display to which a driving method of a liquid crystal display according to embodiments of the present disclosure is applied will be described with reference to FIG. 1.

FIG. 1 is an exploded perspective view of a liquid crystal display (LCD) according to an embodiment of the present disclosure.

The LCD to which an embodiment of present disclosure is applied is formed of a liquid crystal panel 300 and a light source unit 900 irradiating light to the liquid crystal panel 300.

Although not shown, the liquid crystal panel 300 includes two substrates facing each other and a liquid crystal layer formed therebetween. Gate lines and data lines are formed in a crossed manner, and a thin film transistor connected to the gate lines and the data lines is formed in one of the two substrates. Further, a pixel electrode connected to the thin film transistor is formed in the substrate, and a common electrode is formed in the same or other substrate, and an electric field is formed between the two electrodes that determines the alignment of the liquid crystal molecules of the liquid crystal layer.

The liquid crystal panel 300 is partitioned into a plurality of regions. For expository reasons, the figure shows first region to eighth region 301, 302, 303, 304, 305, 306, 307, and 308.

The light source unit 900 is disposed below the liquid crystal panel 300 and radiates light thereto, and a given percentage of the light may be emitted from the liquid crystal panel 300 according to the alignment of the liquid crystal molecules.

The light source unit 900 is partitioned into a plurality of blocks. For expository reasons, the figure shows first to eighth blocks 901, 902, 903, 904, 905, 906, 907, 908, and 909. The first to eighth blocks of the light source unit 900 respectively correspond to the first to eighth regions 301, 302, 303, 304, 305, 306, 307, and 308 of the liquid crystal panel 300. Thus, light emitted from each block of the light source unit 900 is radiated to each region of the liquid crystal panel 300 corresponding to the block. For example, light emitted from the first block 901 is radiated to the first region 301 of the liquid crystal panel 300, and light emitted from the second block 902 is radiated to the second region 302 of the liquid crystal panel 300.

The light source unit 900 may be formed from various light sources, such as light emitting diodes (LED), cold cathode fluorescent lamps (CCFL), or external electrode fluorescent lamps (EEFL).

The light source unit 900 may be classified into a perpendicular irradiation type or a side irradiation type. The perpendicular irradiation type is disposed directly below the liquid crystal panel 300 and directly radiates light thereto, while the side irradiation type radiates light through a light guide plate to the liquid crystal panel 300. Either of the two types may be used as the light source unit 900.

As described above, the liquid crystal panel 300 is formed of 8 regions and the light source unit 900 is formed of 8 blocks. However, embodiments of the present disclosure are not limited thereto, and the liquid crystal panel 300 may be partitioned into more or fewer regions, and accordingly, the light source unit 900 may be partitioned into more or fewer blocks.

In the drawing, the regions and blocks of the liquid crystal panel 300 and the light source unit 900 are shown as extending in parallel with a horizontal direction. However, embodiments of the present disclosure are not limited thereto, and the regions and blocks of the liquid crystal panel 300 and the light source unit 900 may extend in parallel with a vertical direction, or form a matrix.

Hereinafter, a method of driving the liquid crystal display according to an embodiment of the present disclosure will be described with reference to the drawings.

Figure 2:
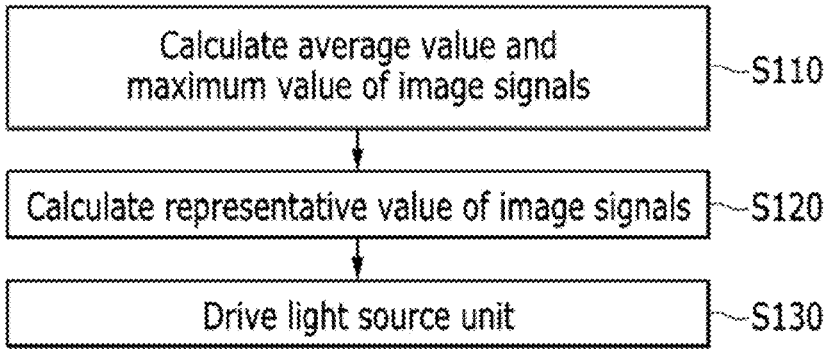
FIG. 2 is a flowchart of a driving method of a liquid crystal display according to an embodiment of the present disclosure.
Figure 3:
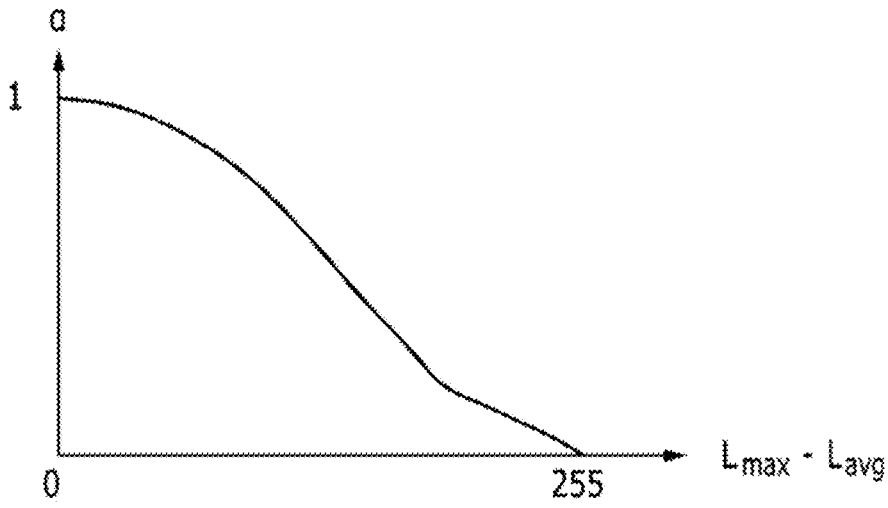
FIG. 3 is a graph showing a value of α in a driving method of the liquid crystal display according to an embodiment of the present disclosure.
Figure 4:
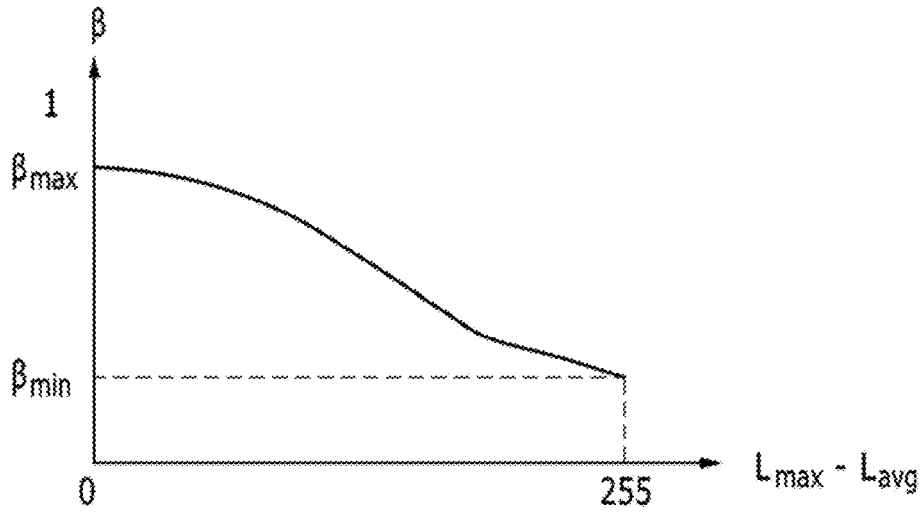
FIG. 4 is a graph showing a value of β in a driving method of the liquid crystal display according to an embodiment of the present disclosure.

FIG. 2 is a flowchart of a method of driving the liquid crystal display according to an embodiment of the present disclosure, FIG. 3 is a graph showing a value of α in a driving method of the liquid crystal display according to an embodiment of the present disclosure, and FIG. 4 is a graph showing a value of β in a driving method of the liquid crystal display according to an embodiment of the present disclosure.

At step S110, an average and maximum image signal voltage value applied to the liquid crystal panel 300 are calculated.

The image signal determines a luminance of each pixel of the liquid crystal panel 300, which may have a value from 0 to 255, where 0 represents black, the lowest luminance, and 255 represents white, the highest luminance. When image signals having mostly low luminance values are displayed, the screen is dark, and when image signals having mostly high luminance values are displayed, the screen is bright.

The average and maximum value are calculated for each region of the liquid crystal panel 300. That is, average and maximum image signal values in the first region 301 are calculated, and average and maximum image signal values in the second region 302 are calculated, and so forth for the third to eighth regions 303, 304, 305, 306, 307, and 308.

At step S120, a representative value of the image signals is calculated using the average and maximum value.

The representative value is a value representing the luminance of the corresponding region, and the luminance of the light source unit 90 may be controlled with reference to the representative value for dimming driving.

The representative value is calculated for each region of the liquid crystal panel 300. That is, a representative value of the first region 301 is calculated using the average and maximum image signal values of the first region 301, a representative value of the second region 302 is calculated using the average and maximum image signal values of the second region 302, and so forth for the third to eighth regions 303, 304, 305, 306, 307, and 308 using the respective average and maximum image signal values for the third to eighth regions 303, 304, 305, 306, 307, and 308.

If a maximum image signal value is used as a representative values, the maximum value controls the luminance of the light source unit 900 to represent all values in corresponding regions of corresponding frames, but power consumption is not significantly reduced. That is, luminance of the light source unit is determined by a high luminance portion not only in a bright screen but also in a dark screen.

If an average image signal value is used as a representative value, luminance of the light source unit 900 is relatively low compared to the case in which the maximum value is used as the representative value, and therefore high luminance values in corresponding regions of corresponding frames cannot be properly represented. However, in a case when the screen is dark but partially lit, the light source unit 900 luminance may be adjusted to an average luminance value to reduce power consumption.

That is, using either the maximum image signal value or the average image signal value as representative values respectively have merits and drawbacks. Thus, according to an embodiment of the present disclosure, a representative value may be calculated as a function of both an average and a maximum image signal value. The representative value may be determined according to Equation 1:

$$L_{rep}=(1-\beta)\times L_{avg}+\beta\times L_{max}, \quad \text{[Equation 1]}$$

where $L_{rep}$ is a representative value, $L_{avg}$ is an average value, and $L_{max}$ is the maximum value.

$\beta$ denotes a value that decreases as a difference between the maximum and average image signal values increases, and has a range between 0 and 1. As given in Equation 1, when $\beta$ is greater than 0.5, the representative value is determined more by the maximum value than the average value, and when $\beta$ is smaller than 0.5, the representative value is determined more by the average value than the maximum value.

Accordingly, the weight of the maximum value in determining the representative value increases as the difference between the maximum and the average image signal values decreases. On the other hand, the weight of the average value in determining the representative value increases as the difference between the maximum and average image signal values increases.

The relationship between increasing the difference between the maximum and the average image signal values and decreasing the value of $\beta$ is non-linear, and the value of $\beta$ is determined as given in Equation 2:

$$\beta=\beta_{min}+\alpha\times(\beta_{max}-\beta_{min}). \quad \text{[Equation 2]}$$

FIG. 3 is a graph of $\alpha$ as a function of the difference $(L_{max}-L_{avg})$. As shown in FIG. 3, $\alpha$ denotes a value that decreases as a difference $(L_{max}-L_{avg})$ between the maximum and an average image signal values increases, and has a range between 0 and 1. When the difference $(L_{max}-L_{avg})$ between the maximum and average image signal values is 0, $\alpha$ is 1, and when the difference $(L_{max}-L_{avg})$ is 255, $\alpha$ is 0.

The relationship between increasing the difference $(L_{max}-L_{avg})$ between the maximum and average image signal values and decreasing the value of $\alpha$ is non-linear, and the value of $\alpha$ can be deter mined from the graph of FIG. 3.

FIG. 4 is a graph of $\beta$ as a function of the difference $(L_{max}-L_{avg})$. As shown in FIG. 4, when the difference $(L_{max}-L_{avg})$ between the maximum average image signal values is 0, $\beta$ is $\beta_{max}$, and when the difference $(L_{max}-L_{avg})$ is 255, $\beta$ is $\beta_{min}$.

$\beta_{min}$ may be set to be between about 0 and about 0.5. $\beta_{max}$ may be set to be between about 0.5 and about 1.

At step S130, the light source unit 900 is driven by determining its luminance according to the representative value.

When the representative image signal value has the highest value, the light source unit 900 is 100% driven, and the driving percentage of the light source unit 900 decreases as the representative value decreases.

The luminance of the light source unit 900 is separately determined for each block, and the light source unit 900 is driven according to the luminance determined for each block. That is, the luminance of a block of the light source unit 900 is determined according to the representative image signal values of the corresponding region.

For example, as the representative image signal value of the first region 301 of the liquid crystal panel 300 decreases, the luminance of the first block 901 of the light source unit 900 decreases, and if the representative image signal value of the second region 302 is low, the luminance of the second block 902 will be low. Likewise, if a representative image signal value for each of the other corresponding regions is low, the luminance of the corresponding block will be low.

According to an embodiment of the present disclosure, when a difference between a maximum and an average image signal value of a corresponding region is small, a representative value is set to a value close to the maximum value, and the luminance of the corresponding block is determined accordingly. Thus, a liquid crystal display with a bright screen properly represents high luminance.

In addition, when a difference between a maximum and an average image signal value of a corresponding region is large, a representative value is set to a value close to the average value, and the luminance of the corresponding block is determined accordingly. Thus, a liquid crystal display with a generally dark and partially lit screen may consume less power.

A light source unit according to an embodiment of the present disclosure may be dimming-driven as described above. Dimming driving methods include global dimming, 1-D local dimming, 2-D local dimming, 3-way dimming, and boosting. Global dimming targets the whole screen. According to 1-D local dimming, the screen is divided with reference to either the vertical axis or the horizontal axis. According to 2-D local dimming, the screen is divided into blocks by lines parallel to both the X-axis and the Y-axis. 3-way dimming performs dimming that incorporates both location and color information. Boosting, such as adaptive luminance and power control (ALPC), enhances luminance for a specific image to optimize emotional image quality.

Local dimming partitions a light source into a plurality of blocks and the luminance of a corresponding block is determined by a representative value of the plurality of blocks of a liquid crystal panel.

However, embodiments of the present disclosure are not limited thereto. A global dimming method may be used according to an embodiment of the present disclosure. For example, a liquid crystal panel may be formed as a single region and the light source unit may be formed as a single block. Thus, a representative image signal value of the entire liquid crystal panel is calculated using average and maximum image signal values to determine luminance of the entire light source unit for driving the light source unit.

Hereinafter, a process for selecting a representative value for each region according to driving methods of a liquid crystal display according to embodiments of the present disclosure for two different images will be described. An image of an exemplary embodiment is generally dark and partially lit, and an image of another exemplary embodiment is generally bright.

A driving method of a liquid crystal display according to an exemplary embodiment of the present disclosure will now be described with reference to FIG. 5.

Figure 5:
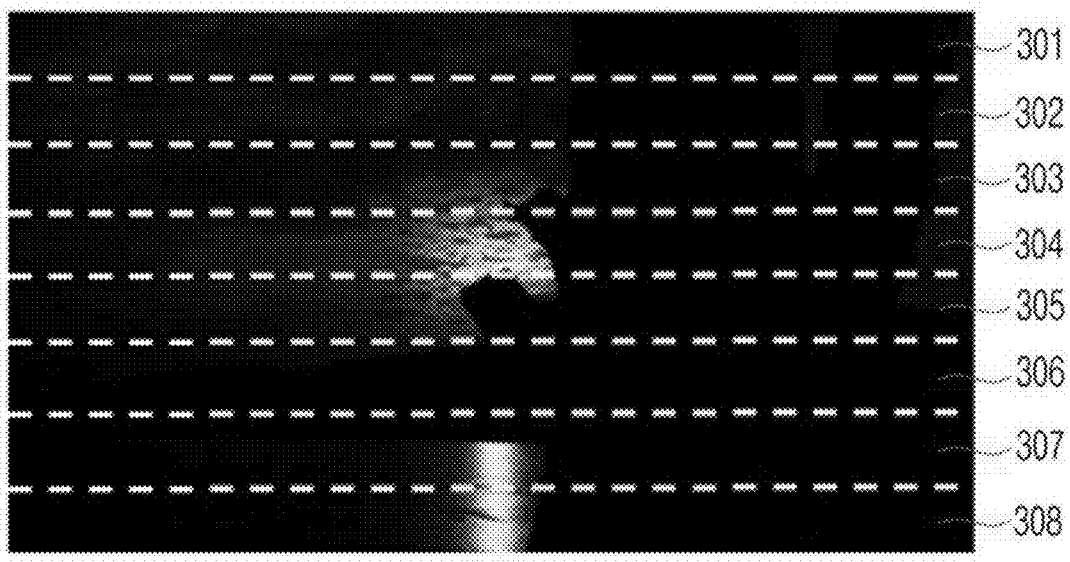
FIG. 5 illustrates a corresponding image for a driving method of a liquid crystal display according to an exemplary embodiment of the present disclosure.
Figure 6:
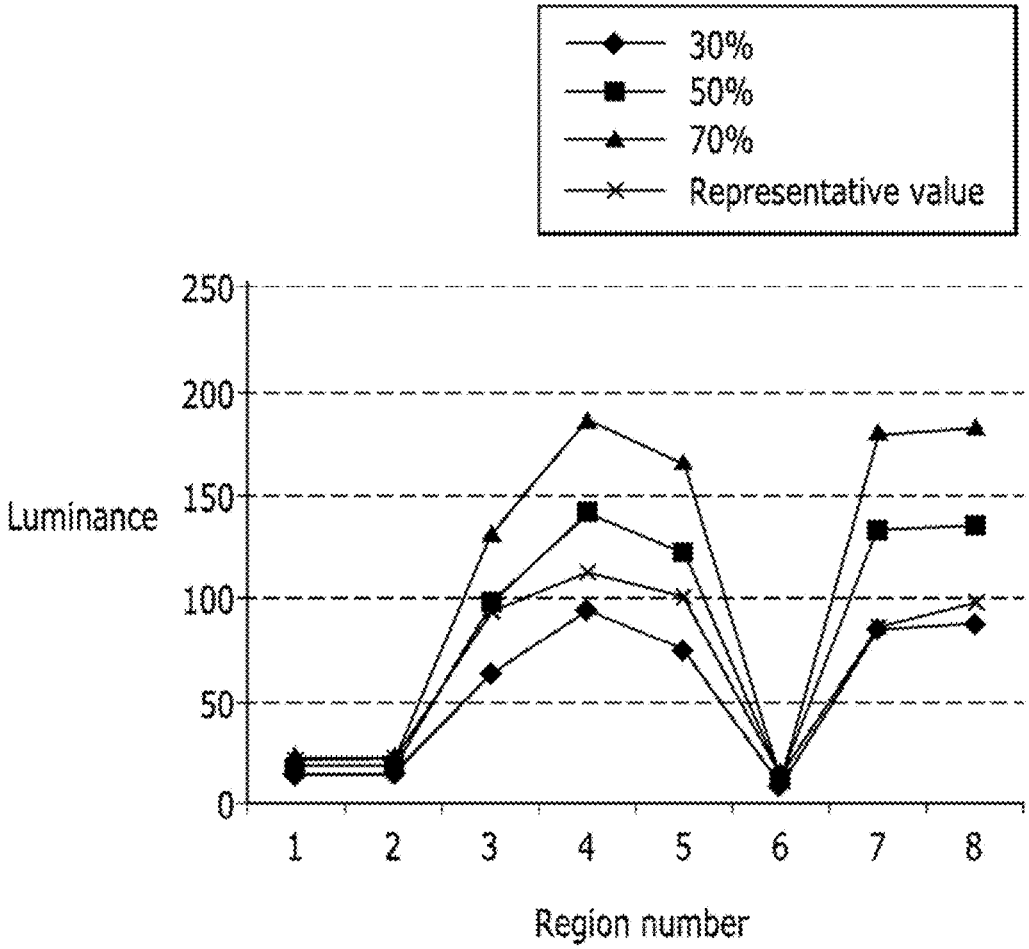
FIG. 6 is a graph showing a representative value of the corresponding area in the driving method of the liquid crystal display according to an exemplary embodiment of the present disclosure.

FIG. 5 shows a corresponding image for a the driving method of the liquid crystal display according to an exemplary embodiment of the present disclosure, and FIG. 6 is a graph showing representative values of the corresponding regions in the driving method of the liquid crystal display according to an exemplary embodiment of the present disclosure.

An exemplary, non-limiting partitioning of the image shown in FIG. 5 divides the image into 8 regions, that is, first to eighth regions 301, 302, 303, 304, 305, 306, 307, and 308. The image is generally dark and only center portions of the third to fifth regions 303, 304, and 305 and the seventh and eighth regions 307 and 308 have high luminance.

Table 1 shows average and maximum image signal values of the image shown in FIG. 5, calculated for each region. Further, Table 1 shows image signal values at 30%, 50%, and 70% of the difference between the average and maximum values and representative value of the corresponding regions, calculated by a method of driving a liquid crystal display according to an embodiment of the present disclosure.

TABLE 1

| Region no. | Average value | Maximum value | 30% | 50% | 70% | Representative value |
|---|---|---|---|---|---|---|
| 1 | 8 | 29 | 15 | 19 | 23 | 22 |
| 2 | 8 | 29 | 15 | 19 | 23 | 22 |
| 3 | 10 | 184 | 63 | 97 | 132 | 93 |
| 4 | 27 | 255 | 96 | 141 | 187 | 112 |
| 5 | 10 | 232 | 77 | 121 | 166 | 100 |
| 6 | 2 | 21 | 8 | 12 | 16 | 15 |
| 7 | 10 | 255 | 84 | 133 | 182 | 86 |
| 8 | 15 | 255 | 87 | 135 | 183 | 97 |

From the graphs shown in FIG. 6, the representative values of the respective regions may be compared with the values at 30%, 50%, and 70% of the difference between the average and maximum values.

In the first, second, and the sixth regions 301, 302, and 306, differences between the maximum values and the average values are respectively 21, 21, and 19. That is, the differences are essentially insignificant. In this case, the representative values of the first, second, and sixth regions 301, 302 and 306 respectively have values between 50% and 70% of the difference between the average and maximum values.

That is, the maximum values are weighted more than the average values in determining the representative values of the first, second, and sixth regions 301, 302, and 306. Since the maximum values differ little from the average values, the representative values are set closer to the maximum values, and thus luminance of the corresponding region can be properly determined while reducing power consumption.

In the third, fourth, fifth, seventh, and eighth regions 303, 304, 305, 307, and 308, differences between maximum and average values are respectively 174, 228, 222, 245, and 240. That is, the differences are significant. In this case, the representative values of the third, fourth, fifth, seventh, and eighth regions 303, 304, 305, 307, and 308 have values between 30% and 50% of the difference between the average and maximum values.

That is, the representative values of the third, fourth, fifth, seventh, and eighth regions 303, 304, 305, 307, and 308 are determined by weighting the average values more than the maximum values. Since the maximum value differs greatly from the average value, the representative value is set closer to the average value and luminance of the light source unit is determined accordingly. If the light source unit is driven with a relatively high luminance even though the screen is essentially dark, power consumption is not significantly reduced. Thus, setting the representative value close to the average value and determining the light source unit luminance accordingly can significantly reduce power consumption.

A driving method of a liquid crystal display according to another exemplary embodiment of the present disclosure will be described with reference to FIG. 7.

Figure 7:
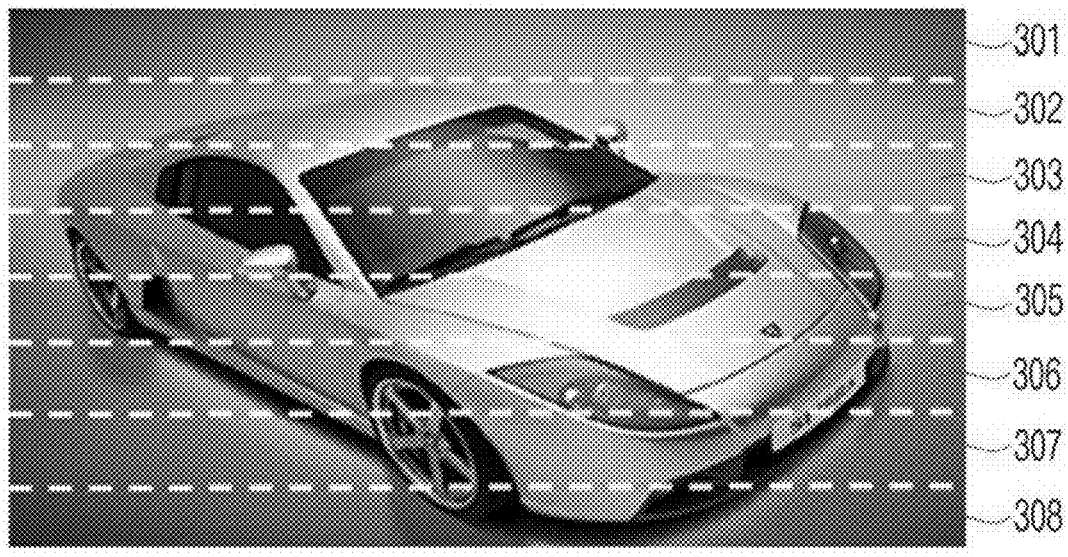
FIG. 7 illustrates the corresponding image in a driving method of a liquid crystal display according to another exemplary embodiment of the present disclosure.
Figure 8:
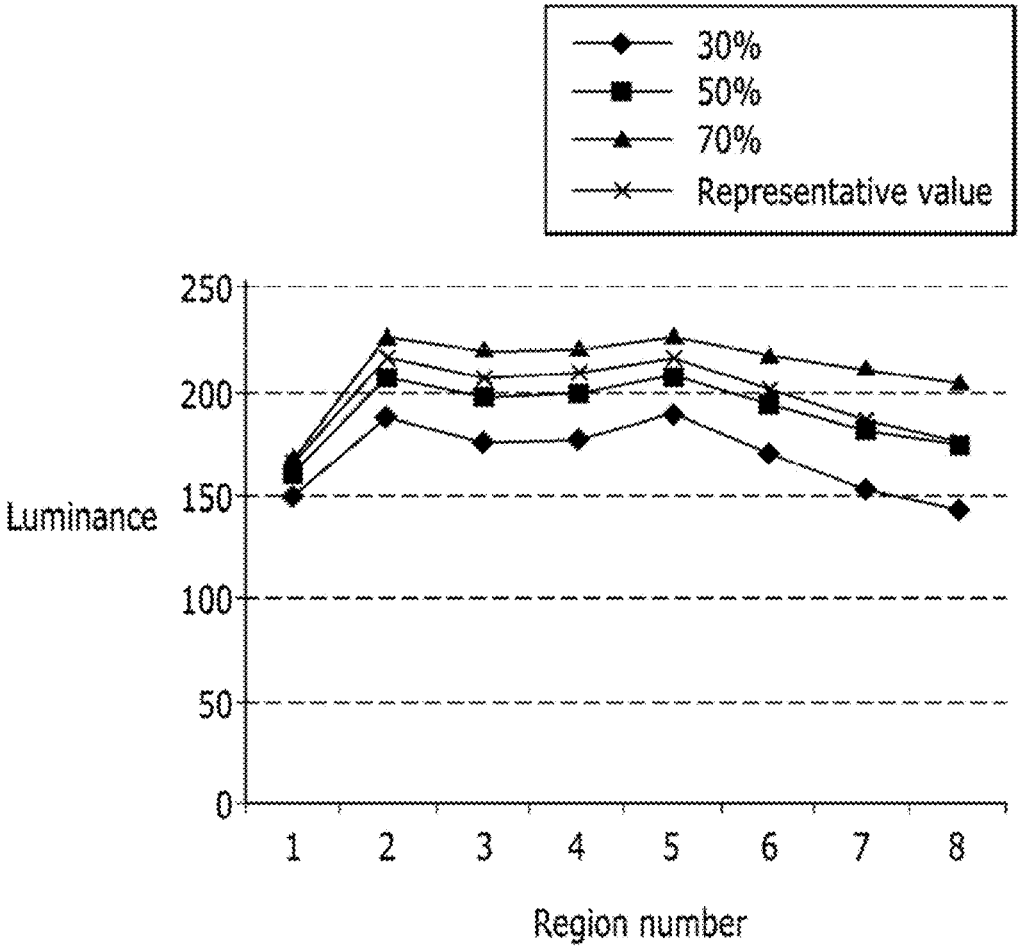
FIG. 8 is a graph showing a representative value of the corresponding area in the driving method of the liquid crystal display according to another exemplary embodiment of the present disclosure.

FIG. 7 shows a corresponding image for a driving method of the liquid crystal display according to another exemplary embodiment of the present disclosure, and FIG. 8 is a graph showing representative values of corresponding regions in a driving method of the liquid crystal display according to another exemplary embodiment of the present disclosure.

An exemplary, non-limiting partitioning of the image shown in FIG. 7 divides the image into 8 regions, that is, first to eighth regions 301, 302, 303, 304, 305, 306, 307, and 308. The image has bright luminance throughout the regions.

Table 2 shows average and maximum image signal values for the image shown FIG. 7, calculated for each region. Further, Table 2 shows image signal values at 30%, 50%, and 70% of the difference between the average and maximum values, and representative values of the corresponding regions calculated using a method of driving a liquid crystal display according to another embodiment of the present disclosure.

TABLE 2

| Region no. | Average value | Maximum value | 30% | 50% | 70% | Representative value |
|---|---|---|---|---|---|---|
| 1 | 132 | 187 | 149 | 160 | 171 | 168 |
| 2 | 160 | 255 | 189 | 208 | 227 | 218 |
| 3 | 141 | 255 | 176 | 198 | 221 | 207 |
| 4 | 145 | 255 | 178 | 200 | 222 | 209 |
| 5 | 162 | 255 | 190 | 209 | 228 | 218 |
| 6 | 134 | 255 | 171 | 195 | 219 | 203 |
| 7 | 109 | 255 | 153 | 182 | 212 | 186 |
| 8 | 95 | 255 | 143 | 175 | 207 | 176 |

From the graph shown in FIG. 8, the representative values of the respective regions may be compared with values at 30%, 50%, and 70% of the difference between the average and maximum values.

Differences between maximum and average values in the first to eighth regions 301 to 308 are respectively 55, 95, 114, 110, 93, 121, 146, and 160. The maximum and average values in all regions differ little from each other. In this case, representative values in the first, second, third, fourth, fifth, sixth, seventh, and eighth regions 301, 302, 303, 304, 305, 306, 307, and 308 are between 50% to 70% of the difference between the average and maximum values. Particularly, the values are close to 50% of the difference between the average values and the maximum values.

That is, the representative values of all regions are determined by weighting about 50% of the average values and the maximum values, and the maximum values are weighted more than the average values in the determination. Since the maximum values differ little from the average values, the luminance of the corresponding region can be appropriately displayed while reducing power consumption, even through the representative values are set closer to the maximum values than to the average values, and the luminance is determined accordingly.

While embodiments of this disclosure has been described in connection with what is presently considered to be exemplary embodiments, it is to be understood that embodiments of the disclosure are not limited to the disclosed embodiments, but, on the contrary, are intended to cover various modifications and equivalent arrangements included within the spirit and scope of the appended claims.

DESCRIPTION OF SYMBOLS

| | |
|---|---|
| 300: liquid crystal panel | 301: first region |
| 302: second region | 303: third region |
| 304: fourth region | 305: fifth region |
| 306: sixth region | 307: seventh region |
| 308: eighth region | 900: light source unit |
| 901: first block | 902: second block |
| 903: third block | 904: fourth block |
| 905: fifth block | 906: sixth block |
| 907: seventh block | 908: eighth block |
| $L_{max}$: representative value | $L_{avg}$: average value |

What is claimed is:

1. A method for driving a light source unit for a liquid crystal display panel, comprising the steps of:

(a) calculating average and maximum values of image signals applied to the liquid crystal panel;

(b) calculating a representative value of the image signals from the average and maximum values of the image signals; and (c) determining a luminance of the light source unit based on the representative value of the image signals and driving the light source unit accordingly, wherein the liquid crystal panel comprises a plurality of regions, the average and maximum values of the image signals are calculated for each region, the representative value of the image signals is calculated for each region from $$L_{rep}=(1-\beta)\times L_{avg}+\beta\times L_{max},$$

wherein $L_{rep}$ is the representative value of the image signals for a given region, $L_{avg}$ is the average value of the image signals for the given region, and $L_{max}$ is the maximum value of the image signals for the given region, $\beta$ is a parameter whose value decreases as a difference between the maximum value of the image signals for the given region and the average values of the image signals for the given region increases, and is between 0 and 1, wherein the value of 13 is calculated from $$\beta=\beta_{min}+\alpha\times(\beta_{max}-\beta_{min}),$$

wherein $\beta_{min}$ and $\beta_{max}$ are predetermined values for $\beta$, and $\alpha$ is a constant parameter for each region with a value between 0 and 1, and wherein the value of $\alpha$ decreases as a difference between the maximum value of the image signals for each region and the average value of the image signals for each region increases.

2. The method of claim 1, wherein the light source unit comprises a plurality of blocks corresponding to the plurality of regions, and the luminance of the light source unit is determined separately for each block.

3. The method of claim 1, wherein the value of $\alpha$ is when the difference between the maximum and average luminance values is 0, and 0 when the difference is 255.

4. The method of claim 1, wherein the value of $\beta_{min}$ is between about 0 and about 0.5.

5. The method of claim 1, wherein the value of $\beta_{max}$ is between about 0.5 and about 1.

6. The method of claim 1, wherein the relationship between increasing the difference between the maximum value and the average value and decreasing the value of $\alpha$ is non-linear.

* * * * *